US006992556B2

(12) United States Patent
Tada et al.

(10) Patent No.: US 6,992,556 B2
(45) Date of Patent: Jan. 31, 2006

(54) INDUCTOR PART, AND METHOD OF PRODUCING THE SAME

(75) Inventors: Nobuhiro Tada, Hyogo (JP); Toshihide Tabuchi, Osaka (JP); Hiroshi Ikezaki, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 213 days.

(21) Appl. No.: 10/275,587

(22) PCT Filed: Mar. 7, 2002

(86) PCT No.: PCT/JP02/02115

§ 371 (c)(1),
(2), (4) Date: Mar. 11, 2003

(87) PCT Pub. No.: WO02/073641

PCT Pub. Date: Sep. 19, 2002

(65) Prior Publication Data

US 2003/0164533 A1 Sep. 4, 2003

(30) Foreign Application Priority Data

| | | |
|---|---|---|
| Mar. 8, 2001 | (JP) | 2001-64581 |
| Mar. 8, 2001 | (JP) | 2001-64582 |
| Mar. 8, 2001 | (JP) | 2001-64583 |
| Mar. 14, 2001 | (JP) | 2001-72202 |
| Mar. 14, 2001 | (JP) | 2001-72203 |

(51) Int. Cl.
*H01F 5/00* (2006.01)

(52) U.S. Cl. ..... 336/200; 336/83

(58) Field of Classification Search ..... 336/65, 336/83, 200, 206–208, 232
See application file for complete search history.

(56) References Cited

U.S. PATENT DOCUMENTS

| | | | | | |
|---|---|---|---|---|---|
| 3,798,059 | A | * | 3/1974 | Astle et al. | 117/212 |
| 4,816,946 | A | * | 3/1989 | Kira et al. | 360/110 |
| 5,552,756 | A | * | 9/1996 | Ushiro | 336/200 |
| 5,609,704 | A | | 3/1997 | Hayama et al. | |
| 6,051,448 | A | | 4/2000 | Hayama et al. | |

FOREIGN PATENT DOCUMENTS

| | | | |
|---|---|---|---|
| EP | 0933788 | | 2/1999 |
| JP | 64-11310 | * | 1/1989 |
| JP | 05-013255 | | 1/1993 |
| JP | 05-055044 | * | 3/1993 |
| JP | 06-120035 | | 4/1994 |
| JP | 07-037719 | | 2/1995 |
| JP | 07-074023 | | 3/1995 |
| JP | 08-083715 | | 3/1996 |
| JP | 11-027074 | | 1/1999 |
| JP | 2000-173824 | | 6/2000 |
| JP | 2000-182872 | | 6/2000 |

OTHER PUBLICATIONS

English translation of Japanese International Search Report for PCT/JP02/02115, dated Jun. 18, 2002.

* cited by examiner

*Primary Examiner*—Tuyen T Nguyen
(74) *Attorney, Agent, or Firm*—RatnerPrestia

(57) ABSTRACT

A printing substrate having a spiral recess filled with conductive paste is placed on an insulation substrate. The conductive paste is transferred onto the insulation substrate, and is then sintered with the insulation substrate to form a coil pattern on a single surface of the insulation substrate. A non-magnetic section of non-magnetic material is formed around the coil pattern. The inductor device having above configuration has excellent attenuation characteristics in a high frequency band, while having a low profile because of a thinner magnetic section.

48 Claims, 10 Drawing Sheets

INDUCTOR PART, AND METHOD OF PRODUCING THE SAME

This application is a U.S. National Phase application of PCT International application PCT/JP02/02115.

TECHNICAL FIELD

The present invention relates to an inductor device including an inductor for use in various consumer equipment for noise filtering, and to a method of manufacturing the device.

BACKGROUND ART

FIG. 9 is an exploded perspective view of a conventional inductor device, FIG. 10 is the perspective view of the device, and FIG. 11 shows impedance-frequency characteristics of the device.

The conventional inductor device includes a magnetic section 1 made of magnetic material, a coil pattern formed of a spiral conductive portion 2 in the magnetic section 1, and an external electrode 3 coupled to the coil pattern electrically.

Plural magnetic layers 4 are laminated to form the magnetic section 1. Each magnetic layer 4 is provided with the spiral conductive portion 2 of the coil pattern having an arc shape of less than one turn. Arc-shaped conductive portions 2 on magnetic layers 4 are electrically coupled through a via-hole 5, thus providing the coil pattern of a few turns in the magnetic section 1.

Conductive portion 2 functions as a common-mode choke coil. FIG. 11 shows impedance-frequency characteristics of the choke coil.

In the conventional inductor device, magnetic section 1 includes plural magnetic layers 4 each having arc-shaped conductive portion 2 thereon are laminated to form the coil pattern in the magnetic section. Therefore, the magnetic material of magnetic section 1 is disposed between conductive portions 2 adjacent to each other on magnetic layers 4 adjacent to each other. Magnetic permeability between conductive portions 2 increases since the layers sandwiches magnetic layer 4, thus increases magnetic flux passing through inside of conductive portion 2 (leakage flux). Magnetic flux passing through the coil pattern decreases accordingly, and this decreases an impedance and resulting insufficient attenuation.

Magnetic material having high permeability generally increases the magnetic flux around the coil pattern, and thus, increase the impedance for preventing attenuation from decreasing.

However, the magnetic material having the high permeability decreases attenuation properties at a high frequency band since a peak of the impedance shifts to a lower frequency band. As shown in the impedance-frequency characteristics in FIG. 11, the inductor device, being used especially as a common mode choke coil, have its attenuation properties decrease in a high frequency band since a peak impedance 6 for a common-mode current, i.e., a noise component, shifts to a lower frequency band. In addition, since a peak impedance 7 for a normal-mode current, i.e., an information signal component, shifts to a lower frequency band, the information signal component attenuates in a lower frequency band.

Magnetic layers 4 are pressed against the coil patterns in their laminating process. For this process, a cross-section of the conductive portion must have a stripe shape having its lateral size smaller than its thickness, so that magnetic layer 4 may be placed easily between conductive portions 2 of the coil pattern.

This configuration, however, increases an area of conductive portions 2 placed on magnetic layers 4 facing each other, and generates stray capacitance in the area. The capacitance decreases the attenuation properties in a high frequency band since the peak impedance shifts to a lower frequency band.

As mentioned above, the conventional inductor device has the decreased attenuation properties in a high frequency band, and hardly have a low profile since a lot of magnetic layers 4 are necessarily be stacked to have the coil of only a few turns.

SUMMARY OF THE INVENTION

An inductor device includes an insulation substrate, a coil pattern including a spiral conductive portion on the insulation substrate, a magnetic section over the coil pattern, the magnetic section being disposed on the insulation substrate, and an external electrode coupled to the coil pattern. The conductive portion is formed through sintering conductive material on the insulation substrate together with the insulation substrate.

The inductor device exhibits excellent attenuation characteristics in a high frequency band and has a low profile because of the magnetic section being thin.

DETAILED DESCRIPTION OF PREFERRED EMBODIMENTS (First Exemplary Embodiment)

Figure 1:
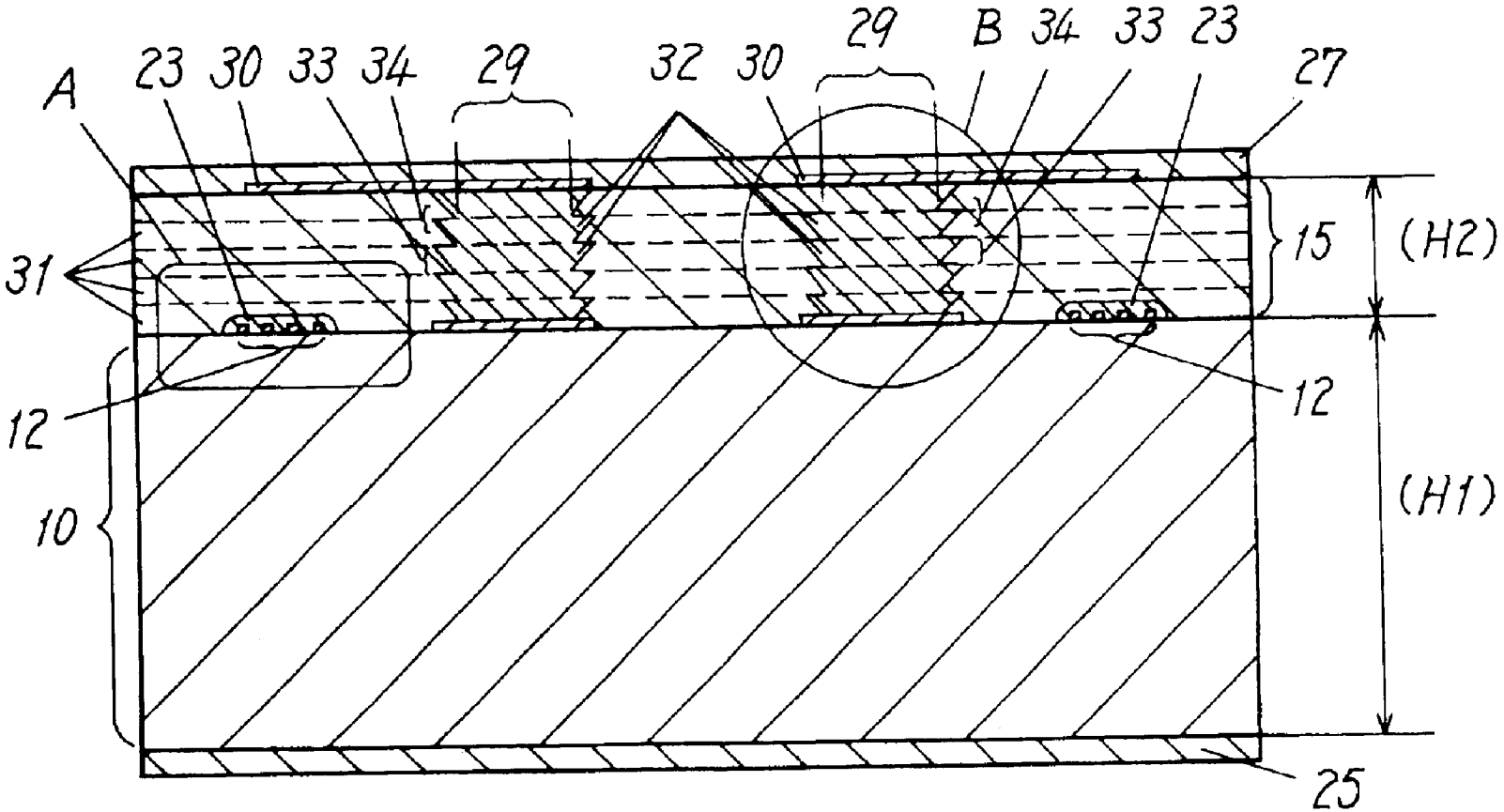
FIG. 1 is a cross-sectional view of an inductor device according to a first exemplary embodiment of the present invention.
Figure 2:
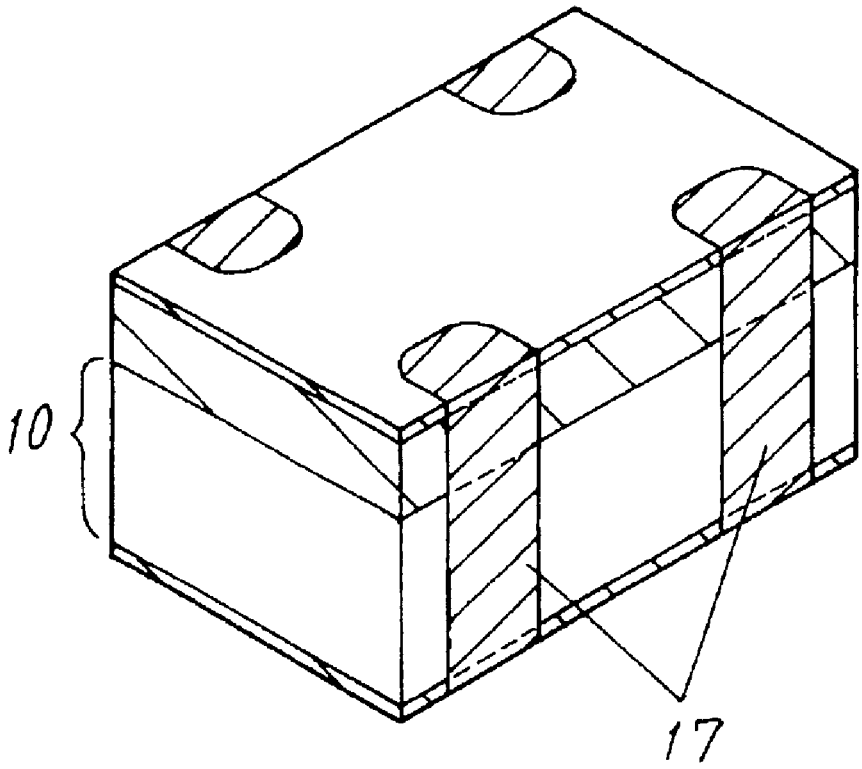
FIG. 2 is a perspective view of the inductor device according to the first embodiment.
Figure 3:
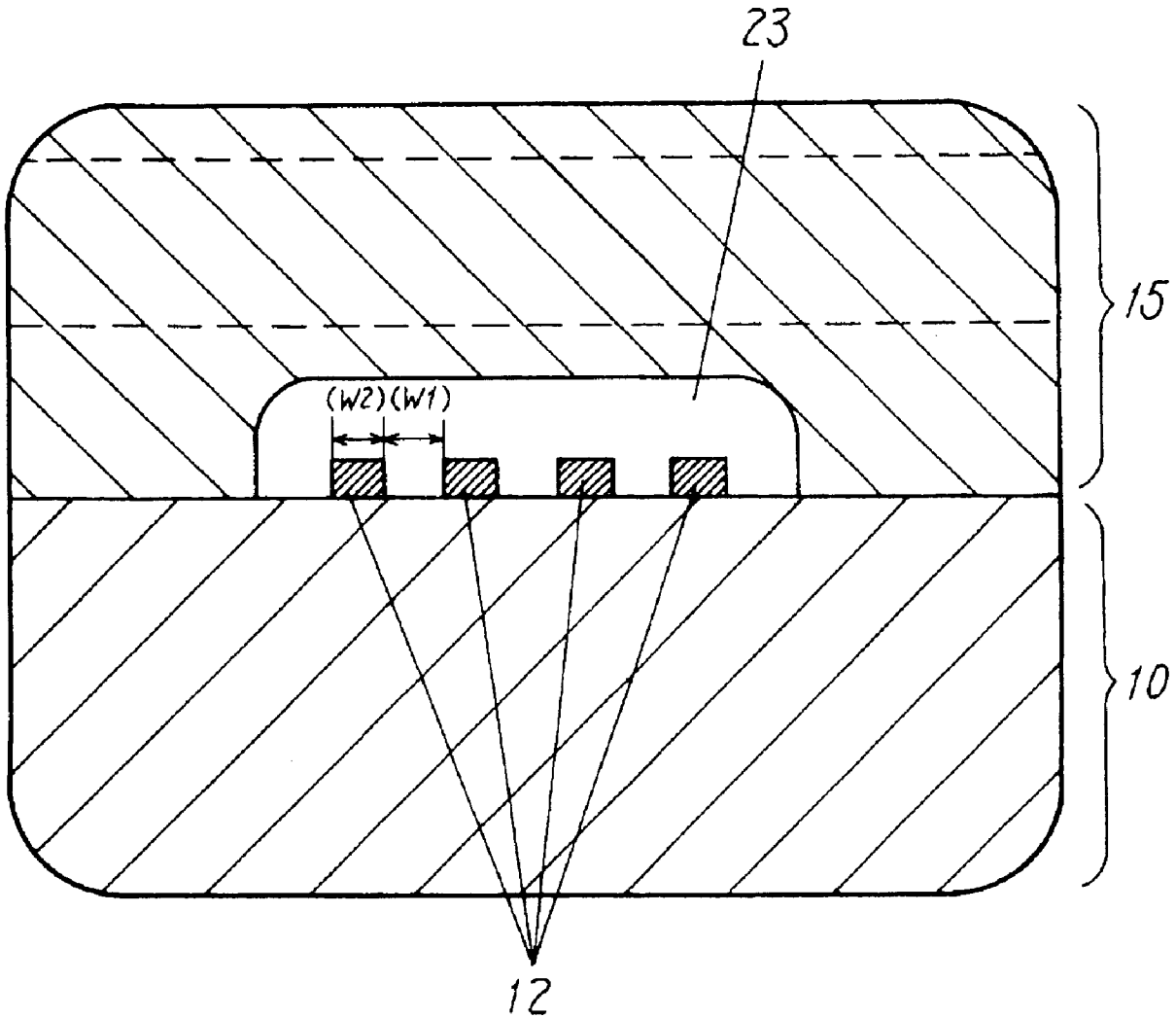
FIG. 3 is an enlarged cross-sectional view of part A of FIG. 1 of the inductor device according to the first embodiment.
Figure 4:
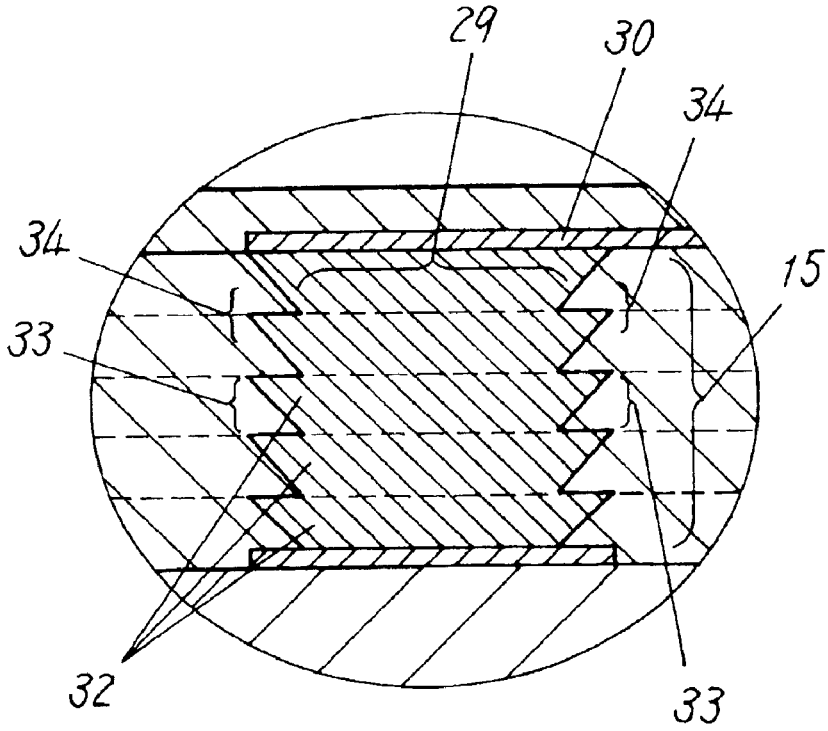
FIG. 4 is an enlarged cross-sectional view of part B in FIG. 1 of the inductor device according to the first embodiment.
Figure 5:
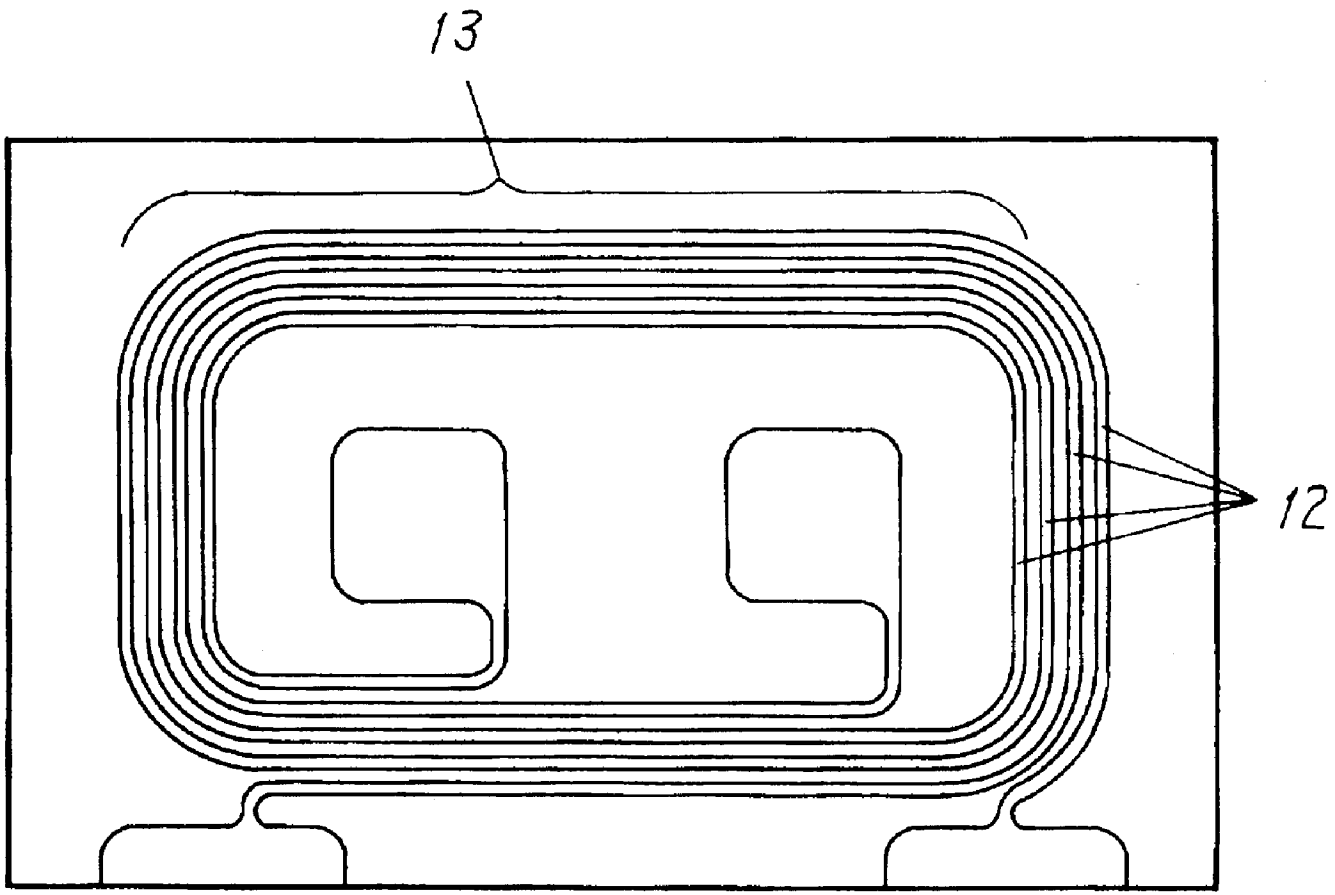
FIG. 5 is a plan view of an insulation substrate provided with a coil pattern in the inductor device according to the first embodiment.
Figure 6:
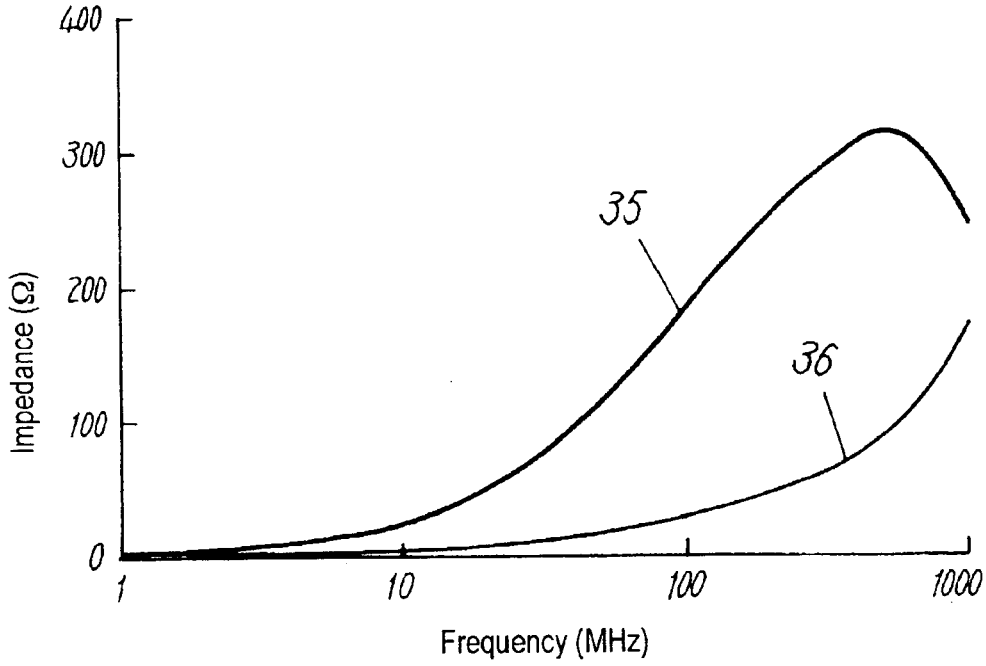
FIG. 6 shows impedance-frequency characteristics of the inductor device according to the first embodiment.
Figure 7:
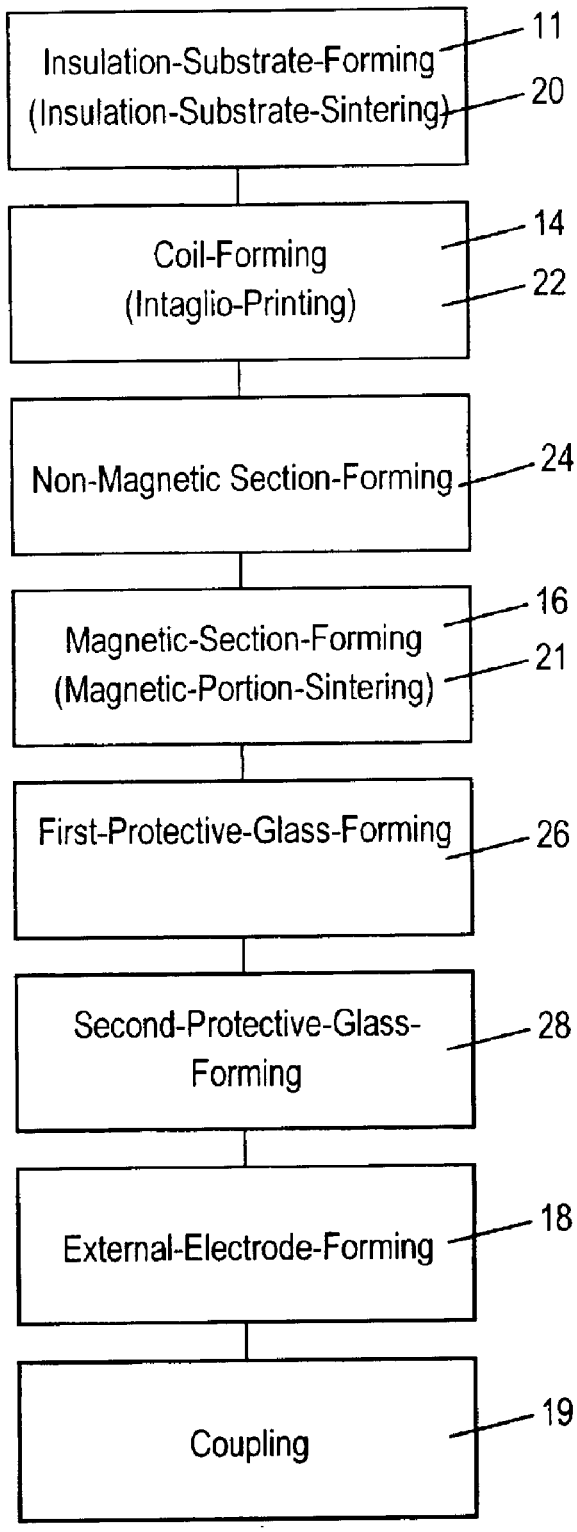
FIG. 7 shows processes of manufacturing the inductor device according to the first embodiment.

FIG. 1 is a cross-sectional view of an inductor device according to a first exemplary embodiment of the present invention. FIG. 2 is a perspective view of the inductor device. FIG. 3 is an enlarged cross-sectional view of part A of FIG. 1 of the inductor device. FIG. 4 is an enlarged cross-sectional view of part B in FIG. 1 of the inductor device. FIG. 5 is a plan view of an insulation substrate provided with a coil pattern in the inductor device. FIG. 6 shows impedance-frequency characteristics of the inductor device. FIG. 7 shows processes of manufacturing the inductor device.

As shown in FIG. 1 through FIG. 5, the inductor device according to the first embodiment has outside dimensions of 0.5 mm to 1.6 mm in length, 1.0 mm to 3.2 mm in width, and 0.9 mm to 1.2 mm in height. The device includes insulation substrate 10 composed of Ni-based ferrite having a relative permeability of approximately 650, spiral coil pattern 13 formed of conductive portion 12 composed of Ag on insulation substrate 10, magnetic section 15 composed of Ni-based ferrite having a relative permeability of approximately 100 on insulation substrate 10, and external electrode 17 electrically coupled to coil pattern 13 via lead-out electrode 30.

Insulation substrate 10 has a thickness (H1) larger than a thickness (H2) of magnetic section 15 but smaller than three times the thickness (H2). Conductive portion 12 is shaped spirally in not less than two turns. A gap between portions adjacent to each other of conductive portion 12 has a width (W1) larger than half of the width (W2) of the conductive portion but smaller than twice the width (W2).

Non-magnetic section 23 made of non-magnetic material, such as non-crystallized glass, is formed around conductive portion 12 of coil pattern 13 to surround coil pattern 13. The non-magnetic material infiltrates into magnetic section 15 to form a non-magnetic layer at a portion of the section 15 adjoining to non-magnetic section 23.

First protective glass 25 made of crystallized glass is laminated on a surface of insulation substrate 10 opposite to coil pattern 13. Second protective glass 27 made of crystallized glass is laminated in parallel with first protective glass 25 on magnetic section 15 on insulation substrate 10.

A via-hole provided in magnetic section 15 is filled with conductive paste composed of Ag to form via-portion 29 which couples coil pattern 13 to external electrode 17 electrically.

Plural magnetic layers 31 each having a through-hole are laminated to form magnetic section 15. Plural via-layers 32 formed through filling the through-holes with the conductive paste are laminated to form via-portion 29. Edge 34 of via-layer 32 protrudes between through-hole peripheries 33 each located between magnetic layers 31 adjoining to each other.

Through-hole peripheries 33 of magnetic layers 31 and edges 34 of via-layers 32 are laminated alternately.

FIG. 6 shows impedance-frequency characteristics of the inductor device. Especially in case that the inductor device having coil pattern 13 formed of conductive portion 12 of two turns is used as a common mode choke coil, impedance 35 for a common mode current, i.e., a noise component, shifts to a higher frequency band compared with conventional inductor devices. And impedance 36 for a normal mode current, i.e., an information signal component, is small within a range covering lower to higher frequency bands,. That is, the inductor device has impedance 36 for the normal mode current, i.e., the information signal component, not reduced in a higher frequency band, while the device has impedance 35 for the common mode current, i.e., the noise component. Therefore, the inductor device has an advantage in transferring a information signal at a high speed of some hundreds Mbps in a high frequency band of approximately 1 GHz.

As shown in FIG. 7, a method of manufacturing the inductor device includes insulation-substrate-forming process 11 to form insulation substrate 10, coil-forming process 14 to form coil pattern 13, having spiral conductive portion 12 on insulation substrate 10, magnetic-section-forming process 16 to forming magnetic section 15 on insulation substrate 10, external-electrode-forming process 18 to form external electrode 17, and coupling process 19 to couple coil pattern 13 to external electrode 17 electrically.

Insulation-substrate-forming process 11 includes insulation-substrate-sintering process 20 to sinter insulation substrate 10 before coil-forming process 14. Magnetic-section-forming process 16 includes magnetic-section-sintering process 21 to sinter laminated magnetic section 15.

Coil-forming process 14 includes intaglio-printing process in which a printing substrate having a spiral recess filled with conductive paste is stacked on insulation substrate 10, the conductive paste is transferred onto insulation substrate 10, and the conductive paste with insulation substrate 10 is sintered to form coil pattern 13 on a surface of insulation substrate 10.

In non-magnetic-section-forming process 24 after coil-forming process 14, non-magnetic section 23 is formed of non-magnetic material, such as non-crystallized glass, around conductive portion 12 of coil pattern 13 to surround pattern 13.

In first-protective-glass-forming process 26 after magnetic-section-forming process 16, first protective glass 25 is stacked on a surface of insulation substrate 10 opposite to printed coil patterns 13, and is then sintered. In second-protective-glass-forming process 28, second protective glass 27 is applied on magnetic section 15 on insulation substrate 10 in parallel with first protective glass 25, and is the sintered.

In coupling process 19, a via-hole is formed in magnetic section 15 and is filled with conductive paste to form via-portion 29, which couples coil pattern 13 to external electrode 17 electrically. Then, coil pattern 13 is electrically coupled to lead-out electrode 30 through via-portion 29.

Plural magnetic layers 31 each having a through-hole formed therein are laminated to form magnetic section 15. Plural via-layers 32 each formed through filling the through-hole with conductive paste are laminated to form via-portion 29. Edges 34 of via-layers 32 protrude between through-hole peripheries 33 of magnetic layers 31 adjoining to each other. Through-hole peripheries 33 of magnetic layers 31 and edges 34 of via-layers 32 are laminated alternately.

Above configure and manufacture processes provide the inductor device with coil pattern 13 having very high-density spiral conductive portion 12 easily. Especially since coil pattern 13 is not divided or formed on different layers in magnetic section 15, whole coil pattern 13 is formed on a single surface. Therefore, magnetic section 15 is not disposed between conductive portions 12 adjacent to each other. This arrangement decreases magnetic flux passing through conductive portions 12 (leakage flux), and increase magnetic flux traveling the coil pattern accordingly. In addition, coil pattern 13 exhibits a strong magnetic coupling, which prevents its attenuation from decreasing.

Magnetic section 15 formed of magnetic material with a low magnetic permeability shifts a peak impedance to a lower frequency band, thus preventing attenuation properties from decreasing.

Magnetic section 15 formed of magnetic material with a low magnetic permeability generally shifts a peak impedance to a lower frequency band, and reduces attenuation properties. However, the strong magnetic coupling of coil patterns 13 prevents attenuation properties from decreasing, while a peak impedance shifts to a high frequency band.

Stray capacitance generated between conductive portions 12 adjacent to each other decreases according to the reduction of the area where conductive portions 12 faces each other since coil pattern 13 is formed on a single plane. Therefore, the inductor device has the peak impedance shifting to a higher frequency band, and has a low profile because of the thin dimensions of magnetic section 15.

Non-magnetic section 23 is formed of non-magnetic material to enclose coil pattern 13 around conductive portion 12 of coil pattern 13. Section 23 decreases magnetic permeability in conductive portion 12, and increases magnetic flux traveling around non-magnetic section 23 enclosing coil patterns 13 since magnetic flux generated in coil pattern 13 is reduced significantly to pass through inside of conductive portion 12, This makes magnetic coupling between conductive portion 12 of coil pattern 13 stronger, thus increasing attenuation properties.

The non-magnetic material, being especially made of glass, can not only reduce magnetic flux passing through conductive portion 12 of coil pattern 13, resulting a stronger magnetic coupling, but also produces no hollow cavity in and around conductive portions 12 of coil pattern 13. Therefore, conductive portion 12 can be prevented from corrosion or migration caused by, for example, moisture existing in air in the hollow cavity.

First protective glass 25 is laminated on a surface of insulation substrate 10 opposite to coil patterns 13, and second protective glass 27 is laminated in parallel with first protective glass 25 on magnetic section 15 on insulation substrate 10. These prevent the surface of insulation substrate 10 and the surface of magnetic section 15 from damage, such as cracks.

Since no hollow cavity is produced on a plane on which magnetic section 15 and via-portion contact to each other, via-portion 29 is prevented from corrosion due to, for example, moisture included in air in the hollow cavity. Via-layers 32 adjoining to each other are electrically coupled precisely even if respective through-holes of the adjoining layers of magnetic section 15 are not positioned correctly each other. Therefore, the inductor device has magnetic section 15 and via-portion 29 with predetermined thicknesses without incorrect electrical coupling.

Coil pattern 13 has spiral conductive portion 12 of not less than two turns. Conductive portion 12 has a gap between portions adjacent to each other having a width larger than ½ but smaller than twice of that of conductive portion 12. This arrangement allows coil pattern 13 of plural turns on a single surface of insulation substrate 10 to be formed accurately without breakage or short-circuit, The inductor device according to the first embodiment has outside dimensions of 0.5 mm to 1.6 mm in length, 1.0 mm to 3.2 mm in width and 0.9 mm to 1.2 mm in height. An inductor having a smaller dimensions, however, can includes coil pattern 13 accurately without breakage or short-circuit.

Insulation substrate 10 has a thickness larger than that of magnetic section 15 but smaller than three times the thickness of section 15. This arrangement provides the inductor device with smaller outside dimensions precisely without breakage or short-circuit.

According to the first embodiment, since coil pattern 13 is formed on a single surface of insulation substrate 10, magnetic section 15 is not sandwiched between conductive portions 12 adjacent to each other. Therefore, the inductor device exhibits an excellent attenuation properties in a higher frequency band, while having low profile because of thin magnetic section 15.

Additionally, ceramics or insulation resin may be employed instead of the glass for the non-magnetic material in the inductor device according to the first embodiment. Non-magnetic section 23 can be provided only around conductive portion 12 of coil pattern 13. This arrangement shortens magnetic flux passing around coil pattern 13, thus reducing the noise component in a higher frequency band.

Coil pattern 13 having plural spiral conductive portion 12 can be applied to, for example, a common mode choke coil requiring plural conductive portion 12.

Each of coil-forming process 14 and magnetic-section-forming process 16 is carried out only once according to the first embodiment, however, each process can be carried out plural times to laminate coil pattern 13 and magnetic section 15 alternatively.

(Second Exemplary Embodiment)

An inductor device according to a second exemplary embodiment is a modification of that of the first embodiment. The device has a hollow cavity instead of non-magnetic section 23, and a non-magnetic layer where non-magnetic infiltrates into magnetic section 15 and insulation substrate 10 around the cavity.

A method of manufacturing the inductor device will be described.

In non-magnetic-section-forming process 24 of the first embodiment, a space in and around conductive portion 12 of coil pattern 13 is filled with glass as the non-magnetic material. During or after magnetic-sintering process 21, the glass is liquefied at a temperature lower than a temperature at the sintering of magnetic section 15 to infiltrate into magnetic section 15 and insulation substrate 10. Glass layers are formed around coil pattern 13, while leaving a hollow cavity formed in and around conductive portion 12.

According to the above configuration, glass filled in and around conductive portion 12 of coil pattern 13 as the non-magnetic material is liquefied to infiltrate into magnetic section 15 and insulation substrate 10. This allows the hollow cavity formed in residual places to function as non-magnetic section 23.

This arrangement decreases a magnetic permeability around conductive portion 12, thus preventing magnetic flux generated in coil pattern 13 from passing around conductive portion 12. Therefore, magnetic flux generated efficiently for traveling around coil pattern 13 induces strong magnetic coupling in conductive portion 12 and increases attenuation properties accordingly.

Moreover, a low dielectric constant of the hollow cavity reduces stray capacitance around conductive portion 12, thus allowing a peak impedance to shift to a higher frequency band.

In addition, the liquefied glass infiltrates into magnetic section 15 and insulation substrate 10 around conductive portion 12 of coil pattern 13 to form the glass layers. The layers reduces the magnetic permeability of magnetic section 15 and allows magnetic section 15 to have non-magnetic properties. That is, non-magnetic section 23 is formed around the hollow cavity. This arrangement lowers the magnetic permeability around conductive portion 12, and thus, prevents the magnetic flux generated in coil pattern 13 from passing through around conductive portion 12. Therefore, magnetic flux generated efficiently for traveling around coil pattern 13 induces strong magnetic coupling in conductive portion 12, thus increases attenuation properties, and allows magnetic section 15 around the hollow cavity to have non-magnetic properties. Therefore, a dielectric constant of the hollow cavity and proximity of the hollow cavity reduces stray capacitance induced around conductive portion 12, and thus, allows a peak impedance to shift to a higher frequency band.

The glass layers formed around the hollow cavity especially prevent moisture from infiltrating into the hollow cavity even if magnetic section 15 has moisture absorption. This arrangement prevents conductive portion 12 from corrosion or migration due to, for example, moisture in the hollow cavity.

(Third Exemplary Embodiment)

A method of manufacturing an inductor device according to a third exemplary embodiment is a modification of that of the first embodiment.

Figure 8:
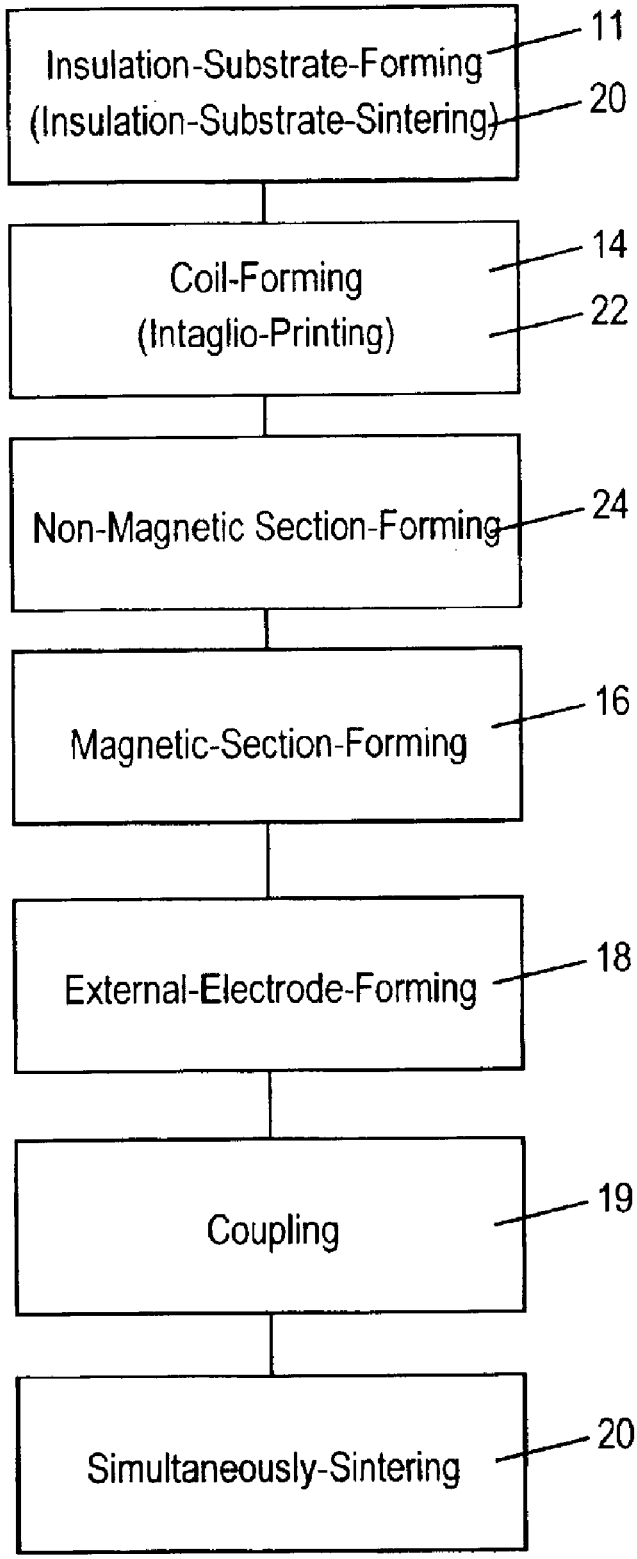
FIG. 8 shows other processes of, manufacturing an inductor device according to a third exemplary embodiment of the invention.
Figure 9:
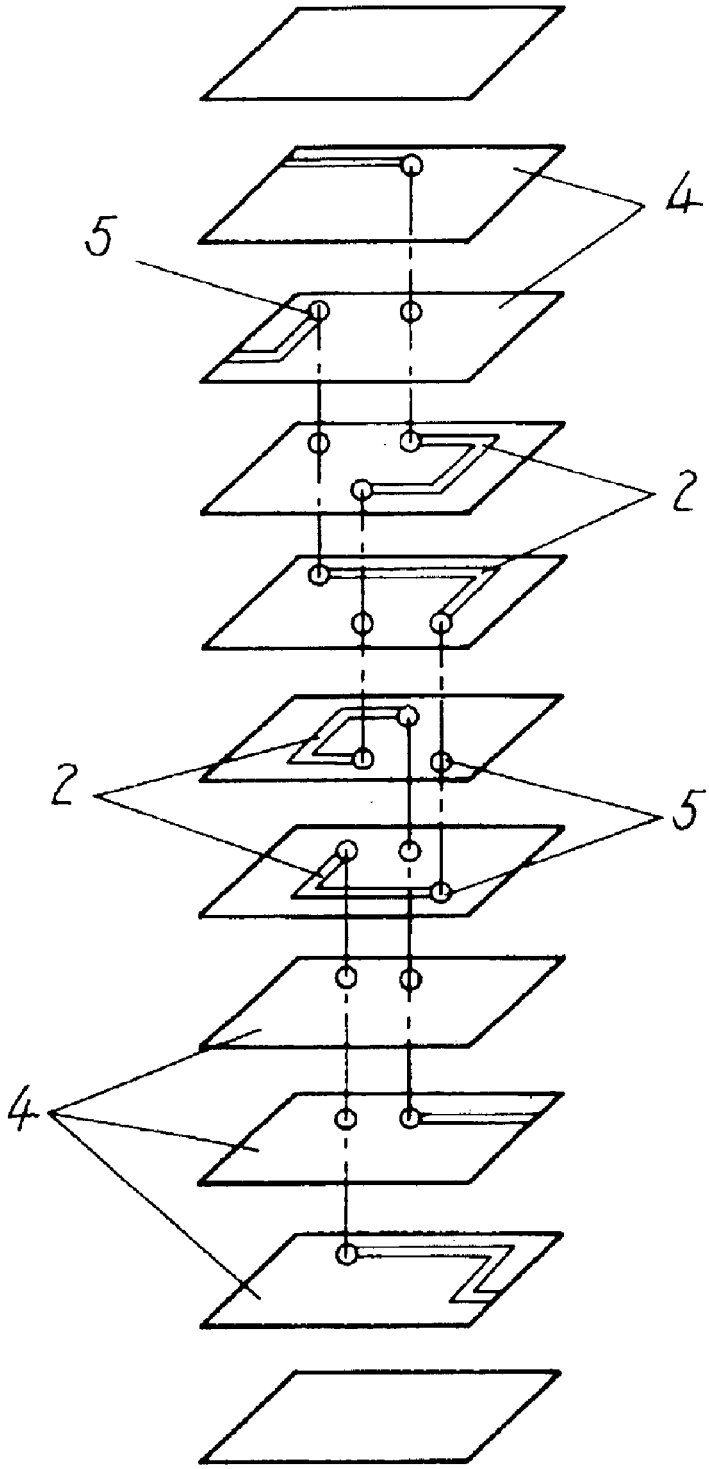
FIG. 9 is an exploded perspective view of a conventional inductor device.
Figure 10:
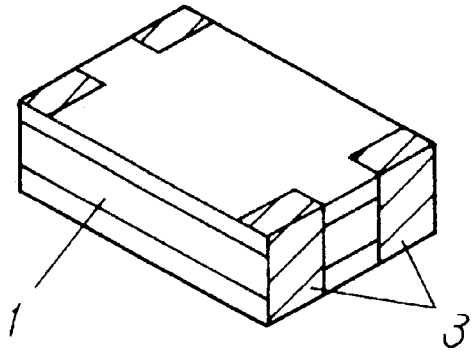
FIG. 10 is a perspective view of the conventional inductor device.
Figure 11:
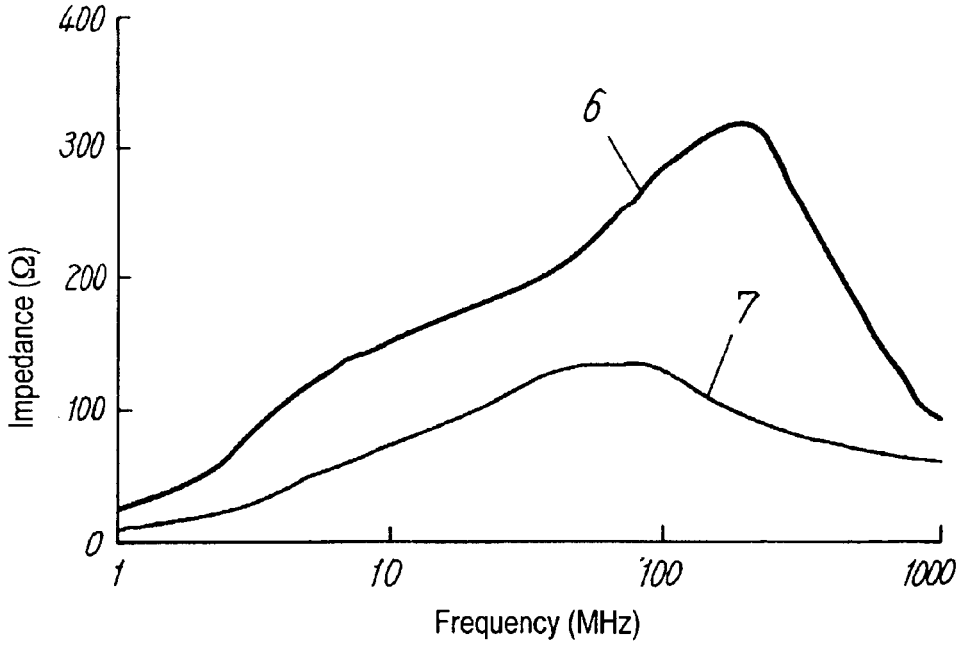
FIG. 11 shows impedance-frequency characteristics of the conventional inductor device.

As shown in FIG. 8, the method of manufacturing the inductor device according to the third embodiment includes insulation-substrate-forming process 11 to form insulation substrate 10, coil-forming process 14 to form coil pattern 13 having spiral conductive portion 12 on insulation substrate 10, magnetic-section-forming process 16 to stack magnetic section 15 on insulation substrate 10, external-electrode-forming process 18 to form external electrode 17, coupling process 19 to couple coil pattern 13 to external electrode 17 electrically, and simultaneously-sintering process 20 to sinter insulation substrate 10, coil patterns 13, and magnetic section 15 together. Simultaneously-sintering process 20 allows insulation substrate 10 and magnetic section 15 not to be sintered in advance.

In intaglio-printing process 22 in coil-forming process 14, a printing substrate having a spiral recess filled with conductive paste is placed on insulation substrate 10, the conductive paste is then transferred onto insulation substrate 10, and coil pattern 13 is then formed on a single surface of insulation substrate 10.

In non-magnetic-section-forming process 24 after coil-forming process 14, non-magnetic section 23 is formed of non-magnetic material, such as glass around conductive portion 12 of coil pattern 13 to surround coil pattern 13.

In coupling process 19, a via-hole is provided in magnetic section 15 and is filled with conductive paste to form via-portion 29. Coil pattern 13 and external electrode 17 are electrically coupled through lead-out electrode 30 and via-portion 29 made of conductive material.

Plural magnetic layers 31 each having a through-hole are laminated to form magnetic section 15. Plural via-layers 32 each having the through-hole filled with conductive paste are laminated to form via-portion 29. Each of edges 34 of via-layers 32 protrudes between through-hole peripheries 33 of magnetic layers 31 adjacent to each other. Through-hole peripheries 33 of magnetic layers 31 and edges 34 of via-layers 32 are laminated alternately.

According to the above configuration, similarly to the first embodiment, coil pattern 13 is formed on a single surface, and magnetic section 15 is not placed between conductive portions 12. Therefore, the inductor device exhibits excellent attenuation properties in a higher frequency band, while having a low profile.

(Fourth Exemplary Embodiment)

A method of manufacturing a inductor device according to a fourth exemplary embodiment is a modification of that of the third embodiment.

In non-magnetic-section-forming process 24 of the third embodiment, an inductor device is filled with glass as non-magnetic material around conductive portion 12 of coil pattern 13. In simultaneously-sintering process 20, a liquefied glass infiltrates into magnetic section 15 and insulation substrate 10 to form a glass layer surrounding coil pattern 13. Simultaneously, a hollow cavity is formed around conductive portion 12.

According to the above configuration, the liquefied glass infiltrates into magnetic section 15 and insulation substrate 10, and thus, allows the hollow cavity formed in a residual place of the glass to function as a non-magnetic section 23.

The above arrangement lowers a magnetic permeability around conductive portion 12, and thus prevents magnetic flux generated in coil pattern 13 from passing through around conductive portion 12. Therefore, magnetic flux generated for traveling around coil pattern 13 induces strong magnetic coupling in conductive portion 12, and increases attenuation properties. In addition, a low dielectric constant of the hollow cavity reduces stray capacitance induced in conductive portion 12, and thus, allows a peak impedance to shift to a higher frequency band.

In addition, the liquefied glass infiltrates into magnetic section 15 around conductive portion 12 of coil pattern 13 to form a glass layer. The layer lowers a magnetic permeability of magnetic section 15 and allows magnetic section 15 to have non-magnetic properties. That is, non-magnetic section 23 is formed also around the hollow cavity. In this case, the lowered magnetic permeability around conductive portion 12 prevents magnetic flux generated in coil pattern 13 from passing through around conductive portion 12. Therefore, magnetic flux generated for traveling around coil pattern 13 induces strong magnetic coupling in conductive portion 12, and thus increases attenuation properties.

Moreover, magnetic section 15 having the non-magnetic properties around the hollow cavity reduces a dielectric constant in and near the hollow cavity more, thus reduces stray capacitance induced around conductive portion 12, and thus allows a peak impedance to shift to a higher frequency band.

In particular, the glass layer formed around the hollow cavity prevents moisture from infiltrating into the hollow cavity through magnetic section 15 even if magnetic section 15 has a moisture absorption. Therefore, conductive portion 12 can be prevented from corrosion or migration due to, for example, moisture in the hollow cavity.

Ceramics or insulation resin can be employed instead of the glass as the non-magnetic material for the inductor device according to the fourth embodiment. The ceramics does not produce the hollow cavity in non-magnetic-section-forming process 24. The insulation resin can provide the hollow cavity since the resin is burnt off at a temperature lower than a temperature at the sintering of magnetic section 15.

INDUSTRIAL APPLICABILITY

In an inductor device according to the present invention, a coil pattern is formed on a single surface. Conductive portions are not formed on magnetic layers adjacent to each other, and thus, no magnetic material sandwiched between the conductive portions. This arrangement allows the inductor device to exhibit excellent attenuation properties and to have a low profile because of a thin magnetic section.

What is claimed is:

1. An inductor device comprising:

an insulation substrate;

a coil pattern including a spiral conductive portion on said insulation substrate;

a magnetic section over said coil pattern, said magnetic section being disposed on said insulation substrate;

a non-magnetic section made of non-magnetic material between portions of said conductive portion and provided on said conductive portion, said non-magnetic section being surrounded by said insulation substrate and said magnetic section; and an external electrode coupled to said coil pattern.

2. The inductor device of claim 1, wherein said coil pattern is formed through placing a printing substrate having a spiral recess filled with conductive paste on said insulation substrate and transferring said conductive paste to said insulation substrate.

3. The inductor device of claim 1, wherein said non-magnetic section is formed around said conductive portion.

4. The inductor device of claim 1, wherein said non-magnetic material is insulation resin.

5. The inductor device of claim 1, wherein said non-magnetic material is glass.

6. The inductor device of claim 1, further comprising:

another coil pattern including another spiral conductive portion on said insulation substrate, said spiral conductive portion being surrounded by said insulation substrate and said non-magnetic portion.

7. The inductor device of claim 1, further comprising:

a first protective glass on a surface of said insulation substrate opposite to said coil pattern.

8. The inductor device of claim 7, further comprising:

a second protective glass on said magnetic section substantially in parallel with said first protective glass.

9. The inductor device of claim 1, further comprising:

a via-portion for coupling said coil pattern to said external electrode, said via-portion being formed through filling a via-hole in said magnetic section with conductive paste.

10. The inductor device of claim 9, wherein said magnetic section includes a plurality of magnetic layers laminated together, and said plurality of magnetic layers have through-holes formed therein, respectively, wherein said via-portion includes a plurality of via-layers formed through filling said through-holes filled with said conductive paste, wherein respective edges of said plurality of via-layers protrude between respective through-hole peripheries of said through-holes, and wherein said through-hole peripheries and edges of via-layers are placed alternately.

11. The inductor device of claim 1, wherein said conductive portion is formed in not less than two turns, and wherein a gap between portions of said conductive portion adjacent to each other is larger than half of a width of said conductive portion and is smaller than twice of said width of said conductive portion.

12. The inductor device of claim 1, wherein said coil pattern further includes another spiral conductive portion on said insulation substrate.

13. The inductor device of claim 1, wherein said insulation substrate and said magnetic section each having a rectangular shape of 0.5 to 1.6 mm by 1.0 to 3.2 mm, and wherein said insulation substrate and said magnetic section having a total height in laminating direction of 0.9 to 1.2 mm.

14. The inductor device of claim 1, wherein said insulation substrate has a thickness larger than a thickness of said magnetic section and smaller than three times said thickness of said magnetic section.

15. The inductor device of claim 1, wherein said magnetic section has a hollow cavity formed around said coil pattern.

16. The inductor device of claim 15, wherein said magnetic section includes a non-magnetic layer formed of non-magnetic material that infiltrates into said magnetic section around said hollow cavity.

17. The inductor device of claim 1, wherein said conductive portion is formed by sintering conductive material on said insulation substrate together with said insulation substrate.

18. An inductor device comprising:

an insulation substrate;

a coil pattern including a spiral conductive portion on said insulation substrate;

a magnetic section over said coil pattern, said magnetic section being disposed on said insulation substrate;

an external electrode coupled to said coil pattern;

a first protective glass on a surface of said insulation substrate opposite to said coil pattern; and a second protective glass on said magnetic section substantially in parallel with said first protective glass.

19. The inductor device of claim 18, wherein said coil pattern is formed through placing a printing substrate having a spiral recess filled with conductive paste on said insulation substrate and transferring said conductive paste to said insulation substrate.

20. The inductor device of claim 18, further comprising:

a non-magnetic section made of non-magnetic material between portions of said conductive portion.

21. The inductor device of claim 20, wherein said non-magnetic section is formed around said conductive portion.

22. The inductor device of claim 20, wherein said non-magnetic material is insulation resin.

23. The inductor device of claim 20, wherein said non-magnetic material is glass.

24. The inductor device of claim 18, further comprising:

another coil pattern including another spiral conductive portion on a surface of said magnetic section opposite to said coil pattern; and another magnetic section over said another coil pattern, another magnetic section being disposed on said magnetic section.

25. The inductor device of claim 18, further comprising a via-portion for coupling said coil pattern to said external electrode, said via-portion being formed through filling a via-hole in said magnetic section with conductive paste.

26. The inductor device of claim 25, wherein said magnetic section includes a plurality of magnetic layers laminated together, and said plurality of magnetic layers have through-holes formed therein, respectively, wherein said via-portion includes a plurality of via-layers formed through filling said through-holes filled with said conductive paste, wherein respective edges of said plurality of via-layers protrude between respective through-hole peripheries of said through-holes, and wherein said through-hole peripheries and edges of via-layers are placed alternately.

27. The inductor device of claim 18, wherein said conductive portion is formed in not less than two turns, and wherein a gap between portions of said conductive portion adjacent to each other is larger than half of a width of said conductive portion and is smaller than twice of said width of said conductive portion.

28. The inductor device of claim 18, wherein said coil pattern further includes another spiral conductive portion on said insulation substrate.

29. The inductor device of claim 18, wherein said insulation substrate and said magnetic section each having a rectangular shape of 0.5 to 1.6 mm by 1.0 to 3.2 mm, and wherein said insulation substrate and said magnetic section having a total height in laminating direction of 0.9 to 1.2 mm.

30. The inductor device of claim 18, wherein said insulation substrate has a thickness larger than a thickness of said magnetic section and smaller than three times said thickness of said magnetic section.

31. The inductor device of claim 18, wherein said magnetic section has a hollow cavity formed around said coil pattern.

32. The inductor device of claim 31, wherein said magnetic section includes a non-magnetic layer formed of non-magnetic material that infiltrates into said magnetic section around said hollow cavity.

33. The inductor device of claim 18, wherein said conductive portion is formed by sintering conductive material on said insulation substrate together with said insulation substrate.

34. An inductor device comprising:

an insulation substrate;

a coil pattern including a spiral conductive portion on said insulation substrate;

a magnetic section over said coil pattern, said magnetic section being disposed on said insulation substrate; and an external electrode coupled to said coil pattern, wherein said magnetic section has a hollow cavity formed around said coil pattern, and wherein said magnetic section includes a non-magnetic layer formed of non-magnetic material that infiltrates into said magnetic section around said hollow cavity.

35. The inductor device of claim 34, wherein said coil pattern is formed through placing a printing substrate having a spiral recess filled with conductive paste on said insulation substrate and transferring said conductive paste to said insulation substrate.

36. The inductor device of claim 34, further comprising:

a non-magnetic section made of non-magnetic material between portions of said conductive portion.

37. The inductor device of claim 36, wherein said non-magnetic section is formed around said conductive portion.

38. The inductor device of claim 36, wherein said non-magnetic material is insulation resin.

39. The inductor device of claim 36, wherein said non-magnetic material is glass.

40. The inductor device of claim 34, further comprising:

another coil pattern including another spiral conductive portion on a surface of said magnetic section opposite to said coil pattern; and another magnetic section over said another coil pattern, another magnetic section being disposed on said magnetic section.

41. The inductor device of claim 34, further comprising:

a via-portion for coupling said coil pattern to said external electrode, said via-portion being formed through filling a via-hole in said magnetic section with conductive paste.

42. The inductor device of claim 41, wherein said magnetic section includes a plurality of magnetic layers laminated together, and said plurality of magnetic layers have through-holes formed therein, respectively, wherein said via-portion includes a plurality of via-layers formed through filling said through-holes filled with said conductive paste, wherein respective edges of said plurality of via-layers protrude between respective through-hole peripheries of said through-holes, and wherein said through-hole peripheries and edges of via-layers are placed alternately.

43. The inductor device of claim 34, wherein said conductive portion is formed in not less than two turns, and wherein a gap between portions of said conductive portion adjacent to each other is larger than half of a width of said conductive portion and is smaller than twice of said width of said conductive portion.

44. The inductor device of claim 34, wherein said coil pattern further includes another spiral conductive portion on said insulation substrate.

45. The inductor device of claim 34, wherein said insulation substrate and said magnetic section each having a rectangular shape of 0.5 to 1.6 mm by 1.0 to 3.2 mm, and wherein said insulation substrate and said magnetic section having a total height in laminating direction of 0.9 to 1.2 mm.

46. The inductor device of claim 34, wherein said insulation substrate has a thickness larger than a thickness of said magnetic section and smaller than three times said thickness of said magnetic section.

47. The inductor device of claim 34, wherein said conductive portion is formed through sintering conductive material on said insulation substrate together with said insulation substrate.

48. An inductor device comprising:

an insulation substrate;

a coil pattern including a spiral conductive portion on said insulation substrate;

a magnetic section over said coil pattern, said magnetic section being disposed on said insulation substrate;

an external electrode coupled to said coil pattern; and a via-portion for coupling said coil pattern to said external electrode, said via-portion being formed through filling a via-hole in said magnetic section with conductive paste, wherein said magnetic section includes a plurality of magnetic layers laminated together, and said plurality of magnetic layers have through-holes formed therein, respectively, wherein said via-portion includes a plurality of via-layers formed through filling said through-holes filled with said conductive paste, wherein respective edges of said plurality of via-layers protrude between respective through-hole peripheries of said through-holes, and wherein said through-hole peripheries and edges of via-layers are placed alternately.

* * * * *